US008544926B2

(12) United States Patent
Braswell

(10) Patent No.: US 8,544,926 B2
(45) Date of Patent: Oct. 1, 2013

(54) SHAFT EXTRACTION

(76) Inventor: Robert Braswell, Amsterdam, NY (US)

( * ) Notice: Subject to any disclaimer, the term of this patent is extended or adjusted under 35 U.S.C. 154(b) by 14 days.

(21) Appl. No.: 13/329,577

(22) Filed: Dec. 19, 2011

(65) Prior Publication Data

US 2013/0154295 A1 Jun. 20, 2013

(51) Int. Cl.
*B66F 19/00* (2006.01)

(52) U.S. Cl.
USPC ..... 294/217; 29/254; 29/278

(58) Field of Classification Search
USPC ..... 294/217, 902, 102.1, 103.1; 29/254, 29/278, 270, 255, 275; 473/324; 81/27
See application file for complete search history.

(56) References Cited

U.S. PATENT DOCUMENTS

| | | | | |
|---|---|---|---|---|
| 2,572,370 | A | 10/1951 | Moeller | |
| 3,826,471 | A | 7/1974 | Orton | |
| 3,890,692 | A | 6/1975 | Jandura | |
| 5,102,100 | A | 4/1992 | Troncoso, Jr. | |
| 5,445,424 | A | 8/1995 | Binette | |
| 5,544,926 | A | 8/1996 | Ravencroft | |
| 5,546,621 | A | 8/1996 | Bulot | |
| 5,765,821 | A * | 6/1998 | Janisse et al. | 269/16 |
| 5,984,272 | A * | 11/1999 | Crider | 254/18 |
| 5,991,997 | A | 11/1999 | Schley et al. | |
| 6,854,776 | B2 | 2/2005 | Downing | |
| 6,994,385 | B2 | 2/2006 | Sigears | |
| 7,234,219 | B2 | 6/2007 | Deiter | |
| 7,682,270 | B2 | 3/2010 | De Buyer-Mimeure | |
| 2004/0051315 | A1 * | 3/2004 | Barker | 285/322 |

FOREIGN PATENT DOCUMENTS

FR 2567259 1/1986

OTHER PUBLICATIONS

Flinch Outdoor Gear On-Line Catalogue, pp. 1-2 Flinch Outdoor Gear Broadhead Extractor: http://www.flinchoutdoorgear.com/broadheadextractors.html.
Darryl L. Woods Review on Flinch Broadhead Extractor, pp. 1-3 Outdoor Product Review.com: Flinch Broadhead Extractor http://outdoorproductreview.com/index.php?option=com_content &view=article&id=47:flinch-broadhead-extractor &catid=25:archery&Itemid=43.
Products found at an online vendor: Lancaster Archery Supply, pp. 1-2 http://www.lancasterarchery.com/shooting-gear/3d-target-accessories/arrow-pullers.html Fivics Arrow puller, Third Hand Pro Puller, October Mountain Products Flex Pull Arrow Puller, AAE Gorilla Grip Arrow Puller, Coffey Wedge-it Arrow Puller, Cartel Rubber Arrow Puller, Booster Arrow Puller.
Double D's Archery Products: http:l/www.ddarchery.com/ Double D's Arrow Puller.

* cited by examiner

*Primary Examiner* — Stephen Vu
(74) *Attorney, Agent, or Firm* — Leber Patent Law P.C.; Celia Leber

(57) ABSTRACT

The shaft removal devices described herein include an elongated gripping portion that allows a shaft, e.g., the shaft of an arrow, to be securely gripped and a force applied in a direction parallel to the long axis of the shaft to be distributed over at least part of the length of the shaft.

12 Claims, 4 Drawing Sheets

SHAFT EXTRACTION

BACKGROUND

Hunting and target archery arrows can frequently get deeply embedded in wood or other similar objects. Removing them intact and undamaged can be difficult if not impossible. The shafts of the arrows alone constitute an expensive investment on the part of the hunter, especially when the shafts are constructed of carbon fiber. A typical carbon fiber arrow shaft can cost between $10 and $20.

SUMMARY

In general, the present disclosure relates to shaft extraction devices that allow an elongated object having a shaft to be removed when an end of the object has become stuck or embedded in another object. In some implementations, the devices are configured to allow an archery arrow to be safely extracted from an object in which it has become embedded without significant (and generally without any) damage to the arrow.

The shaft extraction devices described herein include an elongated gripping element that is removably clamped onto a shaft by a clamping device. The gripping element and clamping device are configured to allow the shaft, e.g., the shaft of an arrow, to be securely gripped without crushing. A force applying element, mounted on the clamping device, allows a force to be applied to the shaft in a direction parallel to the long axis of the shaft.

In some implementations, the clamping device connects the gripping portion to a slide weight assembly that includes a slide rod and a slide hammer and which is configured to allow a force to be applied to the gripping portion and, thus, to the shaft, in a direction substantially parallel to the axis of the shaft when the slide hammer is actuated.

The devices disclosed herein allow a force to be applied to a shaft so as to allow an object that includes the shaft, e.g., an arrow, to be retrieved without significant damage to the shaft or the need for application of excessive amounts of force by the user. For example, when an arrow is embedded in an object, e.g., a wood stump or tree, the device can be clamped onto the arrow shaft with a clamping force that is sufficient to limit slippage when the slide hammer is actuated and yet not so excessive that damage to the arrow shaft is incurred. The slide weight is tapped against a slide stop by the user, which, with each subsequent tap, incrementally backs the arrow out of the object.

In one aspect, the invention features a shaft extraction device that includes (a) a gripping element configured to grip a portion of a shaft having a longitudinal axis, and distribute a force applied to the gripping element over the portion; (b) a clamping device, mounted on the gripping element, configured to releasably secure the gripping element to the shaft; and (c) a force applying element, mounted on the clamping device, the force applying element being configured to allow an extraction force to be applied to the gripping element in a direction parallel to the axis of the shaft.

Some implementations can include one or more of the following features. For example, the force applying element can include a slide rod, and the device can further include a slide hammer slidably mounted on the slide rod. The gripping element can include a pair of hemi-cylindrical elements, which can range in length, for example, from 2 to 6 inches, and can be configured to be positioned on opposite sides of the shaft. Furthermore, the hemi-cylindrical elements can be lined with an elastomeric material that can have, for example, a Shore A durometer of about 30 to 85.

Some implementations of the clamping device can comprise locking pliers. The clamping device can be secured to the gripping device. The clamping device can be configured to allow the force applied to the shaft through the gripping elements by the clamping device to be adjustable.

Some implementations of the slide rod can have a length from about 2 to 3 feet. The slide rod may have a slide stop which limits the travel of the slide hammer along the slide rod.

In some implementations, the longitudinal axis of the force applying element is substantially perpendicular to the longitudinal axis of the clamping device. In addition, some implementations of the clamping device will have a longitudinal axis, which is substantially parallel to the longitudinal axis of the gripping device. In other implementations, the longitudinal axis of the clamping device is perpendicular to that of the gripping device.

In another aspect, the invention features shaft extraction methods, which comprise (a) gripping a portion of a shaft having a longitudinal axis with a gripping element; (b) releasably securing the gripping element to the shaft with a clamping element; and (c) applying a force to the gripping element, using a force applying element that is mounted on the clamping device and that has a longitudinal axis that is substantially perpendicular to a longitudinal axis of the clamping device.

DETAILED DESCRIPTION

As discussed above, the shaft extraction devices described herein include a gripping element that releasably grips the shaft to be extracted, a clamping device that secures the gripping element in place on the shaft, and a force applying element that allows a force to be applied to the gripping element, and thus to the shaft, in a direction generally parallel to the long axis of the shaft.

Figure 1:
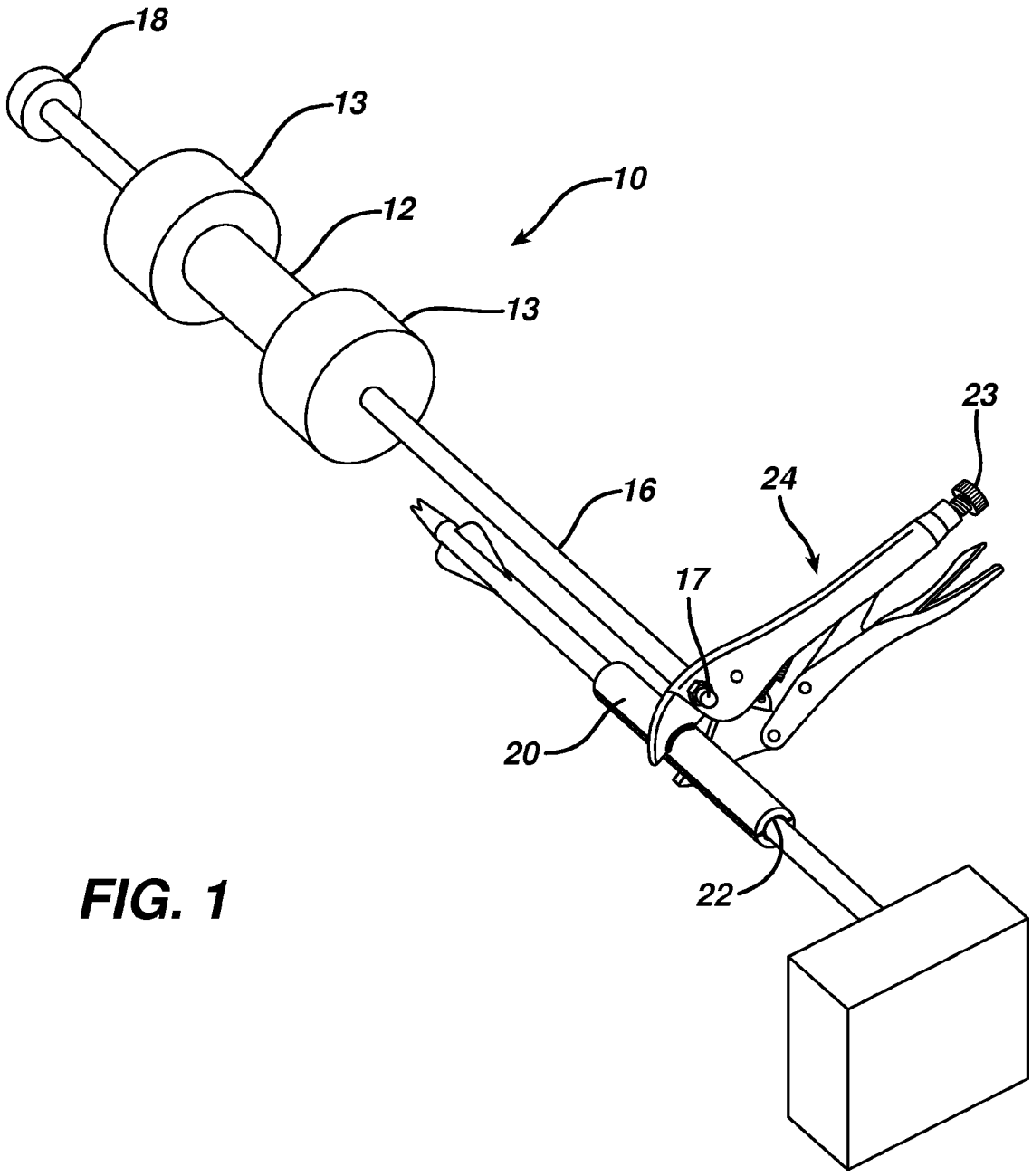
FIG. 1 is a perspective view of a device.

Referring to FIG. 1, a shaft extractor assembly 10 includes a slide assembly (force applying element) that includes a slide hammer 12, a slide rod 16 and a slide stop 18, a clamping device 24 mounted on the slide rod, and a gripping element, in the form of a pair of hemi-cylindrical elements 20, for example halves of a rigid tubular member, e.g., pipe halves, mounted on the clamping device.

The slide hammer 12 generally ranges in weight from about 1 to 5 pounds and can have a length ranging from about 4 to 8 inches. Generally, the length and weight of the slide hammer are determined by the force that needs to be applied to extract the shaft (e.g., the force required to back an arrow head and shaft out of an object in which it is embedded), and the portability requirements of the particular application. The slide hammer 12 is shaped with flared flanges 13 at both ends, which serve to protect the user's fingers from being pinched during operation. The slide hammer 12 moves along the slide rod 16, which generally ranges in length from 2 to 3 feet when the device is intended for arrow removal. The slide rod 16 is generally long enough to give the slide hammer sufficient travel distance without negatively impacting the portability of the device. The slide rod 16 is generally formed of a metal, e.g., steel or aluminum, and may be solid or hollow. Generally, the slide hammer 12 operates on the slide rod 16 behind the nock of the arrow.

Figure 1A:
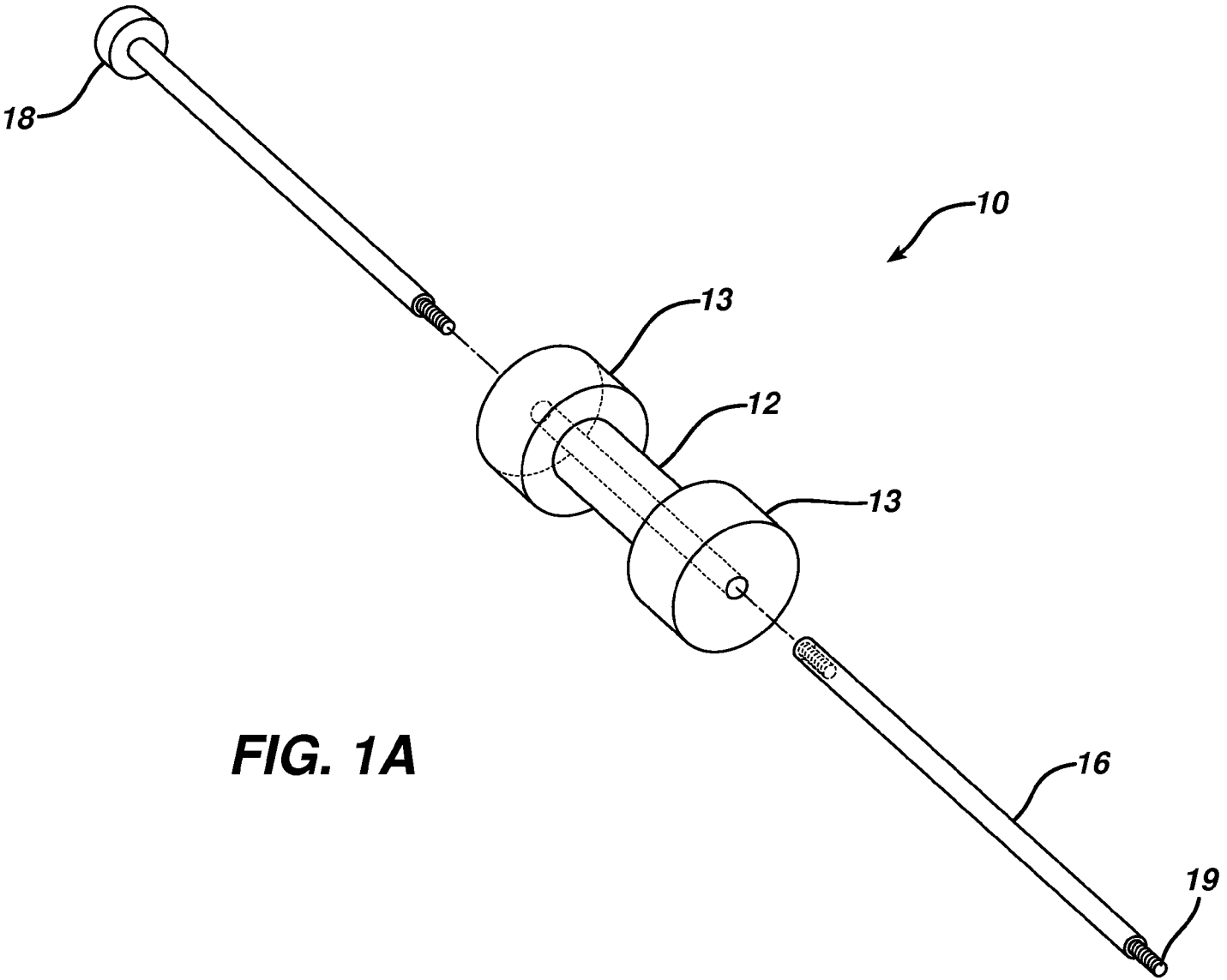
FIG. 1A is an exploded perspective view of a multi-piece slide rod that may be used in the device shown in FIG. 1.

Referring to FIG. 1A, in some implementations, the slide rod 16 may be formed of multiple pieces to allow the device to be easily transportable. The pieces may, for example, be threaded together or otherwise held together, provided the joint between them is sufficiently smooth for the slide hammer to go over without undue interference. The diameter of the slide rod will generally be selected to allow the slide rod to support the weight of the slide hammer, without unduly increasing the overall weight of the device. In some cases, the diameter of the slide rod may be from 0.12 to 0.38 inches. A slide stop 18 at one end of the slide rod 16 serves as the impact point for the slide hammer 12.

In some implementations, the slide rod 16 is attached to the clamping device 24 such that its long axis is substantially perpendicular to that of the clamping device 24, preferably at a 90° angle plus or minus 1°. The slide rod may be attached, e.g., by threading a threaded end of the slide rod 16 into a threaded through opening in the clamping device 16 and securing with a nut 17. The substantially perpendicular mounting of the clamping device on the slide rod ensures that the force generated by actuating the slide hammer 16 against the slide stop 18 (the extraction force) is transmitted to the arrow shaft along its axis.

Figure 3:
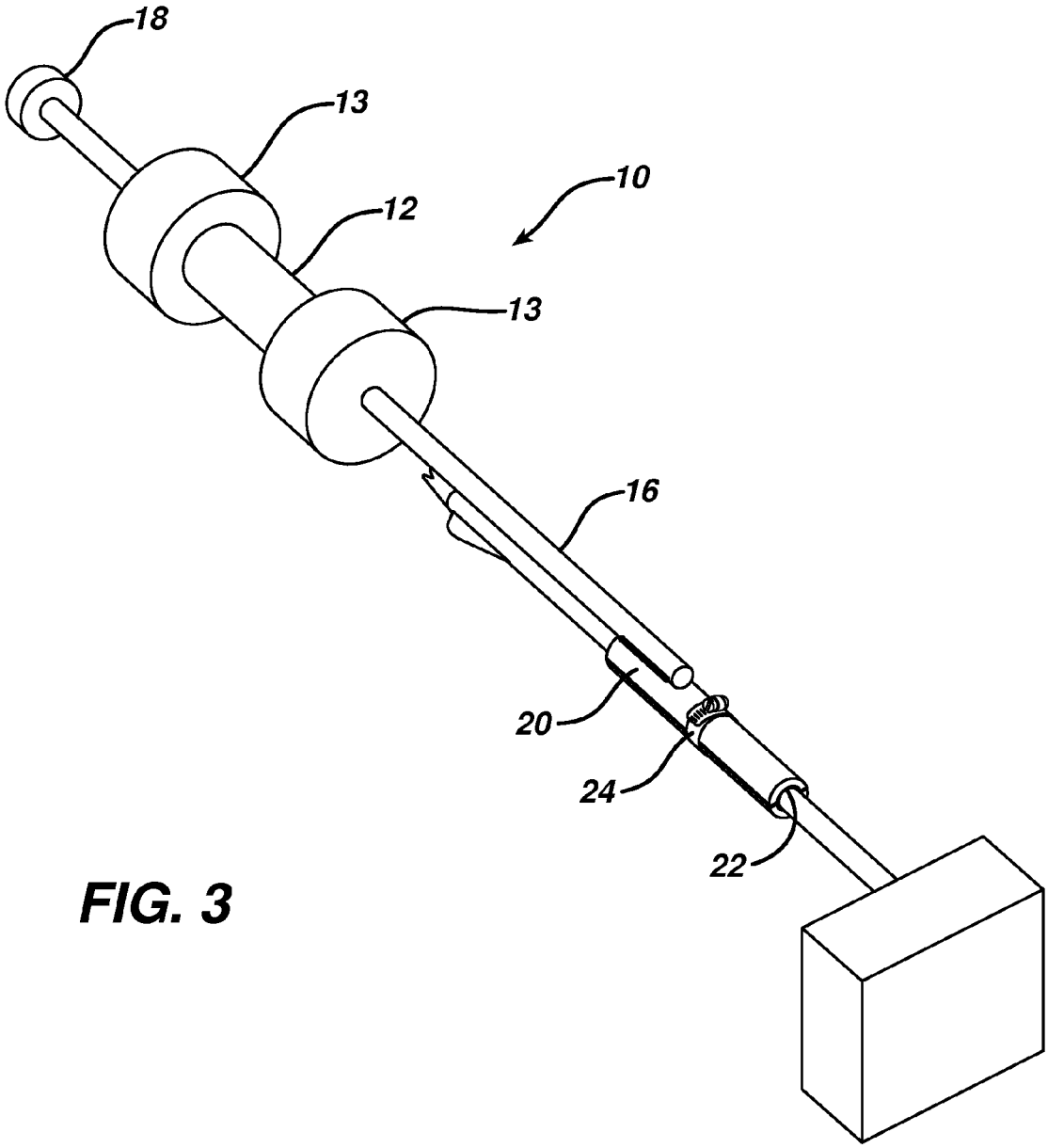
FIG. 3 is a perspective view of a device according to an alternative embodiment.

Referring to FIG. 3, in an alternative embodiment the slide rod 16 is welded directly to an outer surface of one of the hemi-cylindrical elements 20, and the hemi-cylindrical elements 20 and the clamping device 24 may be, for example, a collet, hose clamp or other device that wraps around the hemi-cylindrical elements 20. In this case, the long axis of the slide rod is not necessarily perpendicular to that of the clamping device, but nonetheless the long axis of the slide rod is still generally parallel to that of the shaft so that the extraction force is transmitted to the arrow shaft along its axis.

Referring to FIG. 1, the clamping device 24 is configured to allow the user to adjust the clamping force applied to the shaft, e.g., from about 200 to 800 Newtons, and the clamping diameter e.g., from about 0.12 to 0.5 inch. This adjustment capability allows the device to be used with a variety of arrow shaft diameters and materials. The material of the arrow shaft, e.g., aluminum, carbon fiber, Kevlar, etc., dictates the specific clamping force needed to secure the device to the arrow shaft to ensure proper operation. For example, using the device on carbon fiber arrow shafts would necessitate less clamping force than is appropriate when the device is used on an aluminum arrow shaft because carbon fiber arrow shafts are more sensitive to crushing forces than aluminum. In some implementations, the clamping device is, or is similar to, a conventional pair of locking pliers. In such implementations, the clamping force may be adjusted by a screw 23. The clamping device 24 also has the ability to be locked when clamped. The locking feature of the clamping device 24 is important to prevent detachment of the device during operation. In some implementations, non-locking pliers may be used, requiring the user to squeeze the pliers while actuating the slide hammer.

In the embodiment shown in FIG. 1, the hemi-cylindrical elements 20 are attached, e.g., welded, to the jaws of the clamping device 24 so that the axis of the cylinder defined by the pipe halves when they are clamped together will be substantially perpendicular to the long axis of the clamping device, and thus substantially parallel to the axis of the metal slide rod 16. Alternatively, as discussed above with reference to FIG. 3, one of the hemi-cylindrical elements 20 can be welded directly to the slide rod 16. Generally, the inner diameter of the hemi-cylindrical elements 20 is sufficiently large to accommodate the expected shaft diameter, for example from about 0.15 to 0.75 inch. The hemi-cylindrical elements 20 may be made of any desired material, e.g., metal or rigid plastic, so long as they are rigid enough to apply pressure to arrow shaft uniformly and not deform locally from pressure of the clamping device. It is important that the hemi-cylindrical elements 20 be essentially parallel to the slide rod 16 to ensure that the extraction force will be applied to the arrow shaft along the axis of the shaft. This prevents damage to the arrow shaft (e.g., bending of the shaft) during the extraction process. The hemi-cylindrical elements 20 should be sufficiently long so as to distribute the force applied by the slide hammer over a significant portion of the length of the shaft. In some implementations, the hemi-cylindrical elements 20 are at least about 2 inches in length, and may range in length from about 2 to 6 inches.

Figure 2:
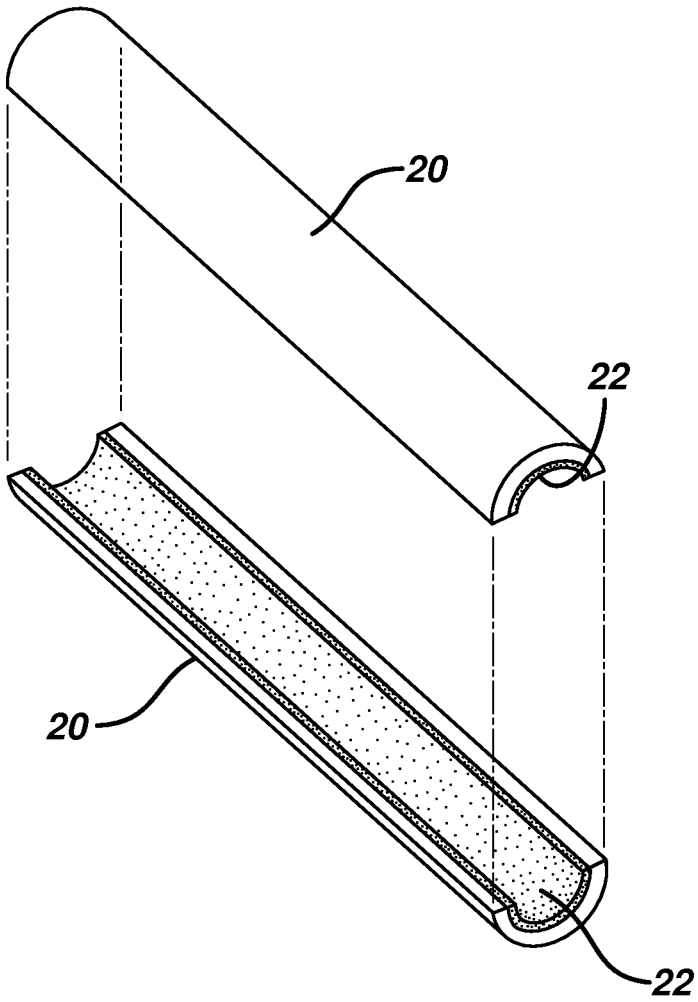
FIG. 2 is an exploded perspective view of the gripping element of the device of FIG. 1.

Referring to FIG. 2, an elastomeric material 22, e.g., a pliable natural or synthetic rubber or elastomer, e.g., Buna-N (nitrile), silicone, etc., of similar length to the hemi-cylindrical elements 20 is attached, e.g., glued or molded, to the inside of each of the hemi-cylindrical elements 20. The elastomeric material 22 serves to protect and cushion the arrow shaft from damage during the extraction process. The elastomeric material 22 is preferably at least 0.06" thick, so as to provide adequate cushioning for a range of shaft diameters. Suitable rubbers include Buna-N nitrile, gum rubber, latex, SBR (styrene-butadiene-rubber), NBR (nitrile-butadiene-rubber), EPDM (ethylene propylene diene monomer), neoprene, viton hypalon, silicone and others. Suitable elastomers include Santoprene®, Norprene™, Cilran™, and PharMed™ elastomers, polyurethane and others. The rubber or elastomer should generally be weather and UV resistant, resistant to tearing, soft enough to grip and not slippery. In some implementations, the material has a Shore A durometer of about 30 to 85.

To use the device, a user unlocks the clamping device 24 (if it is locked), and positions the hemi-cylindrical elements 20 on either side of the shaft to be extracted. The user then locks the clamping device 24, first adjusting the clamping force if necessary by adjusting the screw 23, and applies a force to the shaft by sliding the slide hammer back and forth against the slide stop. It is generally preferred that the user operate the slide hammer with moderate force, e.g., a force that will incrementally move the arrow head about 1/16" per hammer blow, so as to avoid applying a potentially damaging force to the arrow.

OTHER EMBODIMENTS

A number of embodiments have been described. Nevertheless, it will be understood that various modifications may be made without departing from the spirit and scope of the disclosure.

For example, other embodiments could be used to extract a variety of types and sizes of shafts, for example a shaft having one end stuck in a machine. Adjustments to the scale of the shaft extraction device would be dictated by the shaft needing to be extracted. Additionally, some embodiments could utilize clamping devices without the use of a rubber or an elastomer.

Other embodiments could omit the slide weight and in its place utilize a plate attached generally perpendicular to the clamping device which could be struck with a hammer or something similar.

Accordingly, other embodiments are within the scope of the following claims.

What is claimed is:

1. A shaft extraction device comprising:

a gripping element configured to be positioned on opposite sides of the shaft configured to grip a portion of the length of a shaft having a longitudinal axis, and distribute a force applied to the gripping element over the portion, the gripping element comprising a pair of hemi-cylindrical elements lined with an elastomeric material, the hemi-cylindrical elements being configured so that when the gripping element grips the shaft a longitudinal axis of each of the hemi-cylindrical elements is generally parallel to or collinear with the longitudinal axis of the shaft and the elastomeric material is in contact with the shaft;

a clamping device, mounted on the gripping element, configured to releasably secure the gripping element to the shaft; and a force applying element, mounted on the clamping device, the force applying element being configured to allow an extraction force to be applied to the gripping element in a direction parallel to the longitudinal axis of the shaft.

2. The shaft extraction device of claim 1, wherein the force applying element comprises a slide rod, and a slide hammer slidably mounted on the slide rod.

3. The shaft extraction device of claim 2, wherein the slide rod has a length from about 2 to 3 feet.

4. The shaft extraction device of claim 2, further including a slide stop, limiting travel of the slide hammer along the slide rod.

5. The shaft extraction device of claim 1, wherein the elastomeric material has a Shore A durometer about 30 to 85.

6. The shaft extraction device of claim 1, wherein the hemi-cylindrical elements have a length from about 2 to 6 inches.

7. The shaft extraction device of claim 1, wherein the clamping device comprises locking pliers.

8. The shaft extraction device of claim 1, wherein the clamping device is configured to allow a clamping force applied by the clamping device to be adjustable.

9. The shaft extraction device of claim 1, wherein the force applying element has a longitudinal axis that is substantially perpendicular to a longitudinal axis of the clamping device.

10. The shaft extraction device of claim 1, wherein the clamping device is secured to the gripping device.

11. The shaft extraction device of claim 10, wherein the longitudinal axis of the clamping device is substantially parallel to a longitudinal axis of the gripping device.

12. A shaft extraction method comprising:

gripping a portion of the length of a shaft having a longitudinal axis with a gripping element comprising a pair of hemi-cylindrical elements lined with an elastomeric material, such that a longitudinal axis of each of the hemi-cylindrical elements is generally parallel to or collinear with the longitudinal axis of the shaft and the elastomeric material is in contact with the shaft;

releasably securing the gripping element to the shaft with a clamping element; and applying an extraction force to the gripping element, using a force applying element that is mounted on the clamping device and that has a longitudinal axis that is substantially perpendicular to a longitudinal axis of the clamping device, wherein the extraction force is in a direction parallel to the longitudinal axis of the shaft.

* * * * *